US008074632B2

(12) United States Patent
Dobbins

(10) Patent No.: US 8,074,632 B2
(45) Date of Patent: Dec. 13, 2011

(54) VARIABLE PNEUMATIC SEAR FOR PAINTBALL GUN

(75) Inventor: Jerrold M. Dobbins, Kuna, ID (US)

(73) Assignee: Kee Action Sports I LLC, Sewell, NJ (US)

( * ) Notice: Subject to any disclaimer, the term of this patent is extended or adjusted under 35 U.S.C. 154(b) by 0 days.

(21) Appl. No.: 12/493,777

(22) Filed: Jun. 29, 2009

(65) Prior Publication Data

US 2010/0083944 A1 Apr. 8, 2010

Related U.S. Application Data

(63) Continuation of application No. 11/183,548, filed on Jul. 18, 2005, now abandoned.

(60) Provisional application No. 60/654,262, filed on Feb. 18, 2005, provisional application No. 60/588,912, filed on Jul. 16, 2004.

(51) Int. Cl.
*F41B 11/00* (2006.01)

(52) U.S. Cl. ..... 124/77

(58) Field of Classification Search ..... 124/71–77; 89/7

See application file for complete search history.

(56) References Cited

U.S. PATENT DOCUMENTS

| | | | |
|---|---|---|---|
| 71,162 | A | 11/1867 | Hall |
| 0,495,767 | A | 4/1893 | Winans |
| 684,055 | A | 10/1901 | Gabbett-Fairfax |
| 2,116,860 | A | 5/1938 | Blaylock |
| 2,568,432 | A | 9/1951 | Cook |
| 2,817,328 | A | 12/1957 | Gale |
| 2,900,972 | A | 8/1959 | Marsh et al. |
| 3,273,553 | A | 9/1966 | Doyle |
| 3,334,208 | A | 8/1967 | Green |
| 3,420,220 | A | 1/1969 | Ferrando |
| 3,630,118 | A | 12/1971 | Stoner |
| 3,788,298 | A | 1/1974 | Hale |
| 3,894,657 | A | 7/1975 | Eckmayr |
| 3,921,614 | A | 11/1975 | Fogelgren |
| 4,044,290 | A | 8/1977 | Gullo |
| 4,147,152 | A | 4/1979 | Fischer et al. |
| 4,148,415 | A | 4/1979 | Florida et al. |
| 4,280,248 | A | 7/1981 | Herubel |

(Continued)

FOREIGN PATENT DOCUMENTS

EP 1197723 4/2002

(Continued)

OTHER PUBLICATIONS

Tippmann Pneumatics, Inc. 98 Custom, $CO_2$ Powered Paintball Gun, Owner's Manual.

(Continued)

*Primary Examiner* — Troy Chambers
(74) *Attorney, Agent, or Firm* — Volpe and Koenig, P.C.

(57) ABSTRACT

An improved paintball gun uses a low-pressure pneumatic sear to hold the firing valve closed against the high pressure gas occupying the other side of the valve. In this manner, only one operation is required between depressing the trigger and the firing of the paintball gun because a double-acting cylinder is not required as an interface between the trigger depression and actuation of the valve. The paintball gun is also substantially faster than existing electro-pneumatic paintball guns because it uses a blow forward bolt, in which higher-pressure gas is held directly behind the bolt and has only one direction to travel during the firing of the paintball gun.

33 Claims, 5 Drawing Sheets

U.S. PATENT DOCUMENTS

| | | | | |
|---|---|---|---|---|
| 4,362,145 | A | 12/1982 | Stelcher | |
| 4,446,599 | A | 5/1984 | Karubian et al. | |
| 4,695,954 | A | 9/1987 | Rose et al. | |
| 4,747,338 | A | 5/1988 | Crutcher | |
| 4,748,600 | A | 5/1988 | Urquhart | |
| 4,770,153 | A | 9/1988 | Edelman | |
| 4,819,609 | A | 4/1989 | Tippmann | |
| 4,850,330 | A | 7/1989 | Nagayoshi | |
| 4,870,945 | A | 10/1989 | Hutchison | |
| 4,922,640 | A | 5/1990 | Toombs | |
| 4,936,282 | A | 6/1990 | Dobbins et al. | |
| 4,986,164 | A | 1/1991 | Crutcher | |
| 5,042,685 | A | 8/1991 | Moulding, Jr. et al. | |
| 5,061,222 | A | 10/1991 | Suris | |
| 5,070,995 | A | 12/1991 | Schaffer et al. | |
| 5,078,118 | A | 1/1992 | Perrone | |
| 5,257,614 | A | 11/1993 | Sullivan | |
| 5,265,582 | A | 11/1993 | Bhogal | |
| 5,280,778 | A | 1/1994 | Kotsiopoulos | |
| 5,333,594 | A | 8/1994 | Robinson | |
| 5,337,726 | A | 8/1994 | Wood | |
| 5,349,938 | A | 9/1994 | Farrell | |
| 5,450,839 | A | 9/1995 | Nicolaevich et al. | |
| 5,462,042 | A | 10/1995 | Greenwell | |
| 5,494,024 | A | 2/1996 | Scott | |
| 5,515,838 | A | 5/1996 | Anderson | |
| 5,542,406 | A | 8/1996 | Oneto | |
| 5,572,982 | A | 11/1996 | Williams | |
| 5,605,140 | A | 2/1997 | Griffin | |
| 5,613,483 | A | 3/1997 | Lukas et al. | |
| 5,630,406 | A | 5/1997 | Dumont | |
| 5,634,456 | A | 6/1997 | Perrone | |
| 5,673,812 | A | 10/1997 | Nelson | |
| 5,704,342 | A | 1/1998 | Gibson et al. | |
| 5,727,538 | A | 3/1998 | Ellis | |
| 5,769,066 | A * | 6/1998 | Schneider | 124/75 |
| 5,771,875 | A | 6/1998 | Sullivan | |
| 5,778,868 | A | 7/1998 | Shepherd | |
| 5,878,736 | A | 3/1999 | Lotuaco, III | |
| 5,881,707 | A | 3/1999 | Gardner, Jr. | |
| 5,913,303 | A | 6/1999 | Kotsiopoulos | |
| 5,967,133 | A | 10/1999 | Gardner, Jr. | |
| 6,003,504 | A * | 12/1999 | Rice et al. | 124/73 |
| 6,024,077 | A | 2/2000 | Kotsiopoulos | |
| 6,035,843 | A | 3/2000 | Smith et al. | |
| 6,065,460 | A | 5/2000 | Lotuaco, III | |
| 6,138,656 | A * | 10/2000 | Rice et al. | 124/73 |
| 6,142,136 | A | 11/2000 | Velasco | |
| 6,233,928 | B1 | 5/2001 | Scott | |
| 6,302,092 | B1 | 10/2001 | Juan | |
| 6,311,682 | B1 | 11/2001 | Rice et al. | |
| 6,349,711 | B1 * | 2/2002 | Perry et al. | 124/73 |
| 6,371,099 | B1 | 4/2002 | Lee | |
| 6,439,217 | B1 | 8/2002 | Shih | |
| 6,470,872 | B1 | 10/2002 | Tiberius et al. | |
| 6,474,326 | B1 | 11/2002 | Smith et al. | |
| 6,516,791 | B2 | 2/2003 | Perrone | |
| 6,532,949 | B1 | 3/2003 | McKendrick | |
| 6,550,468 | B1 | 4/2003 | Tippmann, Jr. | |
| 6,553,983 | B1 | 4/2003 | Li | |
| 6,561,176 | B1 | 5/2003 | Fujimoto et al. | |
| 6,568,381 | B2 | 5/2003 | Chang | |
| 6,618,975 | B1 | 9/2003 | Shih | |
| 6,626,165 | B1 | 9/2003 | Bhogal | |
| 6,637,420 | B2 | 10/2003 | Moritz | |
| 6,637,421 | B2 | 10/2003 | Smith et al. | |
| 6,644,295 | B2 | 11/2003 | Jones | |
| 6,644,296 | B2 | 11/2003 | Gardner, Jr. | |
| 6,658,982 | B2 | 12/2003 | Cherry | |
| 6,668,478 | B2 | 12/2003 | Bergstrom | |
| 6,675,791 | B1 | 1/2004 | Alexander et al. | |
| 6,694,963 | B1 | 2/2004 | Taylor | |
| 6,701,909 | B2 | 3/2004 | Tiberius et al. | |
| 6,705,036 | B2 | 3/2004 | Orr | |
| 6,708,685 | B2 | 3/2004 | Masse | |
| 6,723,464 | B2 | 4/2004 | Kurvinen | |
| 6,732,464 | B2 | 5/2004 | Kurvinen | |
| 6,763,822 | B1 | 7/2004 | Styles | |
| 6,766,795 | B1 | 7/2004 | Sullivan | |
| 6,802,305 | B1 | 10/2004 | Hatcher | |
| 6,810,871 | B2 | 11/2004 | Jones | |
| 6,832,605 | B2 | 12/2004 | Farrell | |
| 6,860,258 | B2 | 3/2005 | Farrell | |
| 6,868,846 | B2 | 3/2005 | Jzn | |
| 6,880,281 | B1 | 4/2005 | Orr | |
| 6,889,681 | B1 | 5/2005 | Alexander et al. | |
| 6,892,718 | B2 | 5/2005 | Tiberius et al. | |
| 6,901,684 | B2 | 6/2005 | Bergstrom | |
| 6,901,689 | B1 | 6/2005 | Ito et al. | |
| 6,901,923 | B2 | 6/2005 | Jones | |
| 6,915,792 | B1 | 7/2005 | Sheng | |
| 6,925,997 | B2 | 8/2005 | Sheng | |
| 6,986,343 | B2 | 1/2006 | Carnall et al. | |
| 7,044,119 | B2 | 5/2006 | Jones | |
| 7,076,906 | B2 | 7/2006 | Monks et al. | |
| 7,086,393 | B1 | 8/2006 | Moss | |
| 7,100,593 | B2 | 9/2006 | Smith et al. | |
| 7,121,272 | B2 | 10/2006 | Jones | |
| 7,185,646 | B2 | 3/2007 | Jones | |
| D546,297 | S | 7/2007 | Jones | |
| 7,237,544 | B2 | 7/2007 | Jones | |
| 7,398,777 | B2 | 7/2008 | Carnall et al. | |
| 7,401,607 | B2 | 7/2008 | Yeh | |
| 7,461,646 | B2 | 12/2008 | Jones | |
| 7,533,664 | B2 | 5/2009 | Carnall | |
| 7,556,032 | B2 | 7/2009 | Jones et al. | |
| 7,575,021 | B2 | 8/2009 | Carnall | |
| 7,591,262 | B2 | 9/2009 | Jones et al. | |
| 7,594,503 | B2 | 9/2009 | DeHaan et al. | |
| 7,603,997 | B2 | 10/2009 | Hensel et al. | |
| 7,610,908 | B2 | 11/2009 | Gardner, Jr. et al. | |
| 7,617,819 | B2 | 11/2009 | Jones | |
| 7,617,820 | B2 | 11/2009 | Jones | |
| 7,640,925 | B2 | 1/2010 | Jones | |
| 7,640,926 | B2 | 1/2010 | Jones | |
| 7,690,373 | B2 | 4/2010 | Telford et al. | |
| 7,712,465 | B2 | 5/2010 | Carnall et al. | |
| 7,753,042 | B2 | 7/2010 | Carnall et al. | |
| 7,779,825 | B2 | 8/2010 | Estrate | |
| 7,934,454 | B2 | 5/2011 | Campo et al. | |
| 2002/0088449 | A1 | 7/2002 | Perrone | |
| 2002/0096164 | A1 | 7/2002 | Perrone | |
| 2003/0005918 | A1 | 1/2003 | Jones | |
| 2003/0024520 | A1 | 2/2003 | Dobbins | |
| 2003/0047175 | A1 | 3/2003 | Farrell | |
| 2003/0066520 | A1 | 4/2003 | Chang | |
| 2003/0079731 | A1 | 5/2003 | Dobbins | |
| 2003/0168052 | A1 * | 9/2003 | Masse | 124/73 |
| 2003/0221684 | A1 | 12/2003 | Rice | |
| 2004/0084038 | A1 | 5/2004 | Gabrel | |
| 2004/0084040 | A1 | 5/2004 | Jones | |
| 2004/0084840 | A1 | 5/2004 | Jones | |
| 2004/0200115 | A1 | 10/2004 | Monks et al. | |
| 2004/0216728 | A1 | 11/2004 | Jong | |
| 2004/0237954 | A1 | 12/2004 | Styles et al. | |
| 2004/0255923 | A1 | 12/2004 | Carnall et al. | |
| 2005/0028802 | A1 | 2/2005 | Jones | |
| 2005/0066952 | A1 | 3/2005 | Lai et al. | |
| 2005/0115550 | A1 | 6/2005 | Jones | |
| 2005/0115551 | A1 | 6/2005 | Carnall et al. | |
| 2005/0115553 | A1 | 6/2005 | Jong | |
| 2005/0115554 | A1 | 6/2005 | Jones | |
| 2005/0133014 | A1 | 6/2005 | Jones | |
| 2005/0155591 | A1 | 7/2005 | Forster | |
| 2005/0183711 | A1 | 8/2005 | Eichner et al. | |
| 2005/0188977 | A1 * | 9/2005 | Wygant | 124/73 |
| 2005/0188978 | A1 * | 9/2005 | Tiberius et al. | 124/74 |
| 2005/0194558 | A1 | 9/2005 | Carnall et al. | |
| 2005/0217655 | A1 | 10/2005 | Jones | |
| 2005/0235976 | A1 | 10/2005 | Carnall | |
| 2005/0268894 | A1 | 12/2005 | Styles et al. | |
| 2006/0005823 | A1 | 1/2006 | Quinn et al. | |
| 2006/0011186 | A1 | 1/2006 | Jones et al. | |
| 2006/0011187 | A1 | 1/2006 | Gardner, Jr. et al. | |
| 2006/0011188 | A1 | 1/2006 | Jones | |
| 2006/0107939 | A1 | 5/2006 | Dobbins | |
| 2006/0124118 | A1 | 6/2006 | Dobbins | |

| | | | |
|---|---|---|---|
| 2006/0137745 | A1 | 6/2006 | Carnall |
| 2006/0162712 | A1 | 7/2006 | Yea |
| 2006/0162714 | A1 | 7/2006 | Lai |
| 2006/0162715 | A1 | 7/2006 | Jones |
| 2006/0169264 | A1 | 8/2006 | Lai |
| 2006/0169266 | A1 | 8/2006 | Carnall et al. |
| 2006/0207585 | A1 | 9/2006 | Liang |
| 2006/0207587 | A1 | 9/2006 | Jones et al. |
| 2006/0225718 | A1 | 10/2006 | Kirwan |
| 2006/0278206 | A1 | 12/2006 | Dobbins et al. |
| 2007/0028909 | A1 | 2/2007 | Wood |
| 2007/0068502 | A1 | 3/2007 | Jones et al. |
| 2007/0151548 | A1 | 7/2007 | Long |
| 2007/0181115 | A1 | 8/2007 | Jong |
| 2007/0186916 | A1 | 8/2007 | Jones |
| 2007/0209650 | A1 | 9/2007 | Jones |
| 2007/0215133 | A1 | 9/2007 | Jones |
| 2007/0215137 | A1 | 9/2007 | Jones et al. |
| 2007/0295320 | A1 | 12/2007 | Carnall et al. |
| 2008/0099005 | A1 | 5/2008 | Kaakkola et al. |
| 2008/0105245 | A1 | 5/2008 | Cole |
| 2008/0178859 | A1 | 7/2008 | Moore et al. |
| 2008/0245351 | A1 | 10/2008 | Kaakkola et al. |
| 2008/0264399 | A1 | 10/2008 | Dobbins et al. |
| 2009/0133682 | A1 | 5/2009 | Dobbins |
| 2010/0083944 | A1 | 4/2010 | Dobbins |
| 2010/0101550 | A1 | 4/2010 | Carnall |
| 2010/0108049 | A1 | 5/2010 | Dobbins |

FOREIGN PATENT DOCUMENTS

| | | |
|---|---|---|
| GB | 631797 | 11/1949 |
| GB | 2198818 | 6/1988 |
| GB | 2313655 | 12/1997 |
| JP | 7225096 | 8/1995 |
| WO | 8805895 | 8/1988 |
| WO | 9813660 | 4/1998 |

OTHER PUBLICATIONS

Indian Creek Design "Freestyle 2004" Operation Manual Version 1.1, 2004 (28 pages).
Indian Creek Design "FreeStyle: 2004" Internet Announcement, 1997 (2 pages).
Paintball 2Xtremes Magazine, "Indian Creek Designs Sponsors CFOA!", Apr. 29, 2004 (3 pages).
Bushmaster™ SI Tournament Marking Gun, Safety and Instruction Manual, 1989, www.icdpaintball.com.
Promaster Si Tournament Marking Gun, Safety and Instruction Manual, 1991, www.icdpaintball.com.
Indian Creek Design BushMaster series, Version 1.2, Model BKO, 1992-2003, www.icdpaintball.com.
BKO, Instruction Manual, Version 1.5, Indian Creek, 1992-2004, www.icdpaintball.com.
Desert Fox, Instruction Manual, Version 1.2, Indian Creek Design, Inc., 1993-1996, www.icdpaintball.com.
Puma™, Version 1.4, Instruction Manual, 1993-1997, www.icdpaintball.com.
Thunder Cat™, Instruction Manual, Version 1.4, Indian Creek Design, Inc., 1993-1997, www.icdpaintball.com.
Bobcat™, Instruction Manual, Version 1.2B, Indian Creek Design, Inc., 1993, 1994, www.icdpaintball.com..
Bob Long's Defiant, Version 1.0, Instruction Manual, 1999, www.icdpaintball.com.
Alley Cat, Instruction Manual, Indian Creek Design, Inc., www.icdpaintball.com.
Indian Creek Design BushMaster series, Version 1.8, Model B2K, 1993-2001, www.icdpaintball.com.
Indian Creek Design BushMaster Series, Version 1.6, Model B2K2, Version 1.6, 1993-2001, Instruction Manual, www.icdpaintball.com.
Indian Creek Design BushMaster series, 1993-2003, Model B2K, Version 2.1, Instruction Manual, www.icdpaintball.com.
B2K PDS, User's Manual, Version 2.1, 1993-2004, Indian Creek Design, www.icdpaintball.com.
B2K Standard, User's Manual, Version 2.1, 1993-2004, Indian Creek Design, www.icdpaintball.com.
May 6, 2009 Office Action from related co-pending U.S. Appl. No. 12/256,832.
Jan. 7, 2010 Office Action from related co-pending U.S. Appl. No. 12/256,832.
Jul. 28, 2010 Notice of Allowance from related co-pending U.S. Appl. No. 12/256,832.
Nov. 16, 2010 Notice of Allowance from related co-pending U.S. Appl. No. 12/256,832.
Aug. 4, 2010 Office Action from related co-pending U.S. Appl. No. 12/613,958.
"ICD" Freestyle Operation Manual Version 1.1, Mar. 2004, 28 pages.
ICD Internet Announcement, Mar. 24, 2004, 2 pages.
"Paintball 2 Extremes," Apr. 29, 2004, 4 pages.
Matrix Owner's Manual by Dye Precision, Inc., Copyright 2003 (9 pages).
DM4 Owner's Manual by Dye Precision, Inc., Copyright 2003 (11 pages).
AirStar Nova 700, Exploded View Diagram (1 page).
SuperNova Manual by AirStar (9 pages).
Nova series by AirStar, Troubleshooting Manual (6 pages).
Nova 700 Breakdown by AirStar (1 page).
Nova 700 Manual by AirStar (4 pages).
World and Regional Paintball Information Guide (WARPIG) Air Star Super Nova ET by Bill Mills, Copyright 1992-2006 (6 pages).
World and Regional Paintball Information Guide (WARPIG) Air Star Nova FAQ, Copyright 1999 (5 pages).
Mayhem Owner's Manual by Paintball Guns International (11 pages).
Assault 80 Manual by War Machine, Inc., Copyright 2004 (9 pages).
World and Regional Paintball Information Guide (WARPIG) Paintball Magazine, Feb. 2000 The E.T. Super Nova, Staff Report (6 pages).
Paintball 2-Xtremes Magazine, Sep. 1999 (vol. 5 No. 9) Super Nova ET: Airstar Joins Electronics Race (5 pages).
Action Pursuit Games magazine, Jan. 2001 Inside AirStar's Supernova ET by James R. "Mad Dog" Morgan, Sr. (6 pages).
Mar. 1, 2011 Office Action from related co-pending U.S. Appl. No. 12/256,832.
Mar. 1, 2011 Office Action from related co-pending U.S. Appl. No. 12/613,958.
World and Regional Paintball Information Guide (WARPIG.com) "AirTech Matrix" by Bill Mills dated Jun. 2001 (10 pages).

* cited by examiner

VARIABLE PNEUMATIC SEAR FOR PAINTBALL GUN

CROSS REFERENCE TO RELATED APPLICATION(S)

This application is a continuation of U.S. patent application Ser. No. 11/183,548 filed on Jul. 18, 2005 which claims the benefit of U.S. Provisional Patent Application Nos. 60/588,912 and 60/654,262 filed Jul. 16, 2004 and Feb. 18, 2005 respectively, the entire contents of all of which are incorporated by reference as if fully set forth herein.

FIELD OF INVENTION

The field of invention is the sport of paintball, and in particular paintball markers used therein.

BACKGROUND

This invention relates generally to the construction of compressed gas guns and more particularly to the guns designed to propel a liquid containing frangible projectile, otherwise known as a "paintball". As used herein, the term "compressed gas" refers to any mean known in the art for providing a fluid for firing a projectile from a compressed gas gun, such as a CO2 tank, a nitrous tank, or any other means supplying gas under pressure. Older existing compressed gas guns generally use a mechanical sear interface to link the trigger mechanism to the hammer or firing pin mechanism. In these guns, a trigger pull depresses the sear mechanism which allows the hammer, under spring or pneumatic pressure, to be driven forward and actuate a valve that releases compressed gas through a port in the bolt, which propels a projectile from the barrel.

This design, however, has many problems, including increased maintenance, damage after repeated cycles, and a higher amount of force is required to drive the hammer mechanism backwards to be seated on the sear. Also, because the sear and resulting hammer must be made of extremely hard materials, the gun is heavy. Such weight is a disadvantage in paintball, where a player's agility works to his advantage.

To overcome the problems of a mechanical sear, people developed other solutions. One solution uses a pneumatic cylinder, which uses spring or pneumatic pressure on alternating sides of a piston to first hold a hammer in the rearward position and then drive it forward to actuate a valve holding the compressed gas that is used to fire the projectile. Although the use of a pneumatic cylinder has its advantages, it requires the use of a stacked bore, where the pneumatic cylinder in the lower bore and is linked to the bolt in the upper bore through a mechanical linkage. It also requires increased gas use, as an independent pneumatic circuit must be used to move the piston backwards and forwards. A further disadvantage is that adjusting this pneumatic circuit can be difficult, because the same pressure of gas is used on both sides of the piston and there is no compensation for adjusting the amount of recock gas, used to drive it backwards, and the amount of velocity gas, which is the amount of force used to drive it forward and strike the valve. This results in erratic velocities, inconsistencies, and shoot-down. In addition, this technology often results in slower cycling times, as three independent operations must take place. First, the piston must be cocked. Second, the piston must be driven forward. Third, a valve is opened to allow compressed gas to enter a port in the bolt and fire a projectile. Clearly, the above design leaves room for improvement.

Single-bore designs have also been developed which place the cylinder and piston assembly in the top bore, usually behind the bolt. This reduces the height of the compressed gas gun, but still requires that a separate circuit of gas be used to drive the piston in alternating directions, which then actuates a valve to release compressed gas, which drives the bolt forward to launch a paintball. These are generally known as spool valve designs. See, for instance, U.S. Pat. Nos. 6,644,295, 5,613,483 and 5,494,024.

Existing spool valve designs have drawbacks as well. Coordinating the movements of the two separate pistons to work in conjunction with one another requires very precise gas pressures, port orifices, and timing in order to make the gun fire a projectile. In the rugged conditions of compressed gas gun use, these precise parameters are often not possible. In addition, adjusting the velocity of a compressed gas gun becomes very difficult, because varying the gas pressure that launches a paintball in turn varies the pressure in the pneumatic cylinder, which causes erratic cycling.

What is needed is a compressed gas gun design that eliminates the need for a separate cylinder and piston assembly and uses a pneumatic sear instead of a pneumatic double-acting cylinder to hold the firing mechanism in place prior to firing a projectile. This allows the gun to be very lightweight and compact, and simplifies adjusting the recock gas used to cock the bolt and the gas used to fire the projectile.

SUMMARY

One aspect of the present invention provides an improved paintball gun that uses a low-pressure pneumatic sear to hold the firing valve closed against the high pressure gas occupying the other side of the valve. In this manner, only one operation is required between depressing the trigger and the firing of the paintball gun because a double-acting cylinder is not required as an interface between the trigger depression and actuation of the valve. The improved paintball gun is also substantially faster than existing electro-pneumatic paintball guns because it uses a blow forward bolt, in which higher-pressure gas is held directly behind the bolt and has only one direction to travel during the firing of the paintball gun.

In operation, a preferably normally open electro-pneumatic valve directs low pressure compressed gas to the front of the firing valve, which is connected to the bolt, which drives the valve backwards in a closed position. On the rearward side of the firing valve, higher-pressure gas is occupying the space surrounding the surface of the firing valve. When the trigger is depressed, it sends an electrical signal to the electropneumatic valve that actuates it. When actuated, the electro-pneumatic valve shuts off and vents to atmosphere the flow of low-pressure gas to the front of the firing valve. As this low pressure gas is being vented, the higher pressure gas on the rear of the firing valve overcomes the pressure on the front of the valve, and the firing valve moves forward, allowing the higher pressure gas to escape around the edges of the valve to be directed down through the center of the bolt to launch the projectile. When the electropneumatic valve is de-actuated, low-pressure gas is then directed to the front of the firing valve, driving it rearwards to seat the valve.

BRIEF DESCRIPTION OF THE DRAWING(S)

Other objects of the invention will be more readily apparent upon reading the following description of embodiments of the invention and upon reference to the accompanying drawings wherein.

DETAILED DESCRIPTION OF THE PREFERRED EMBODIMENT(S)

Figure 1:
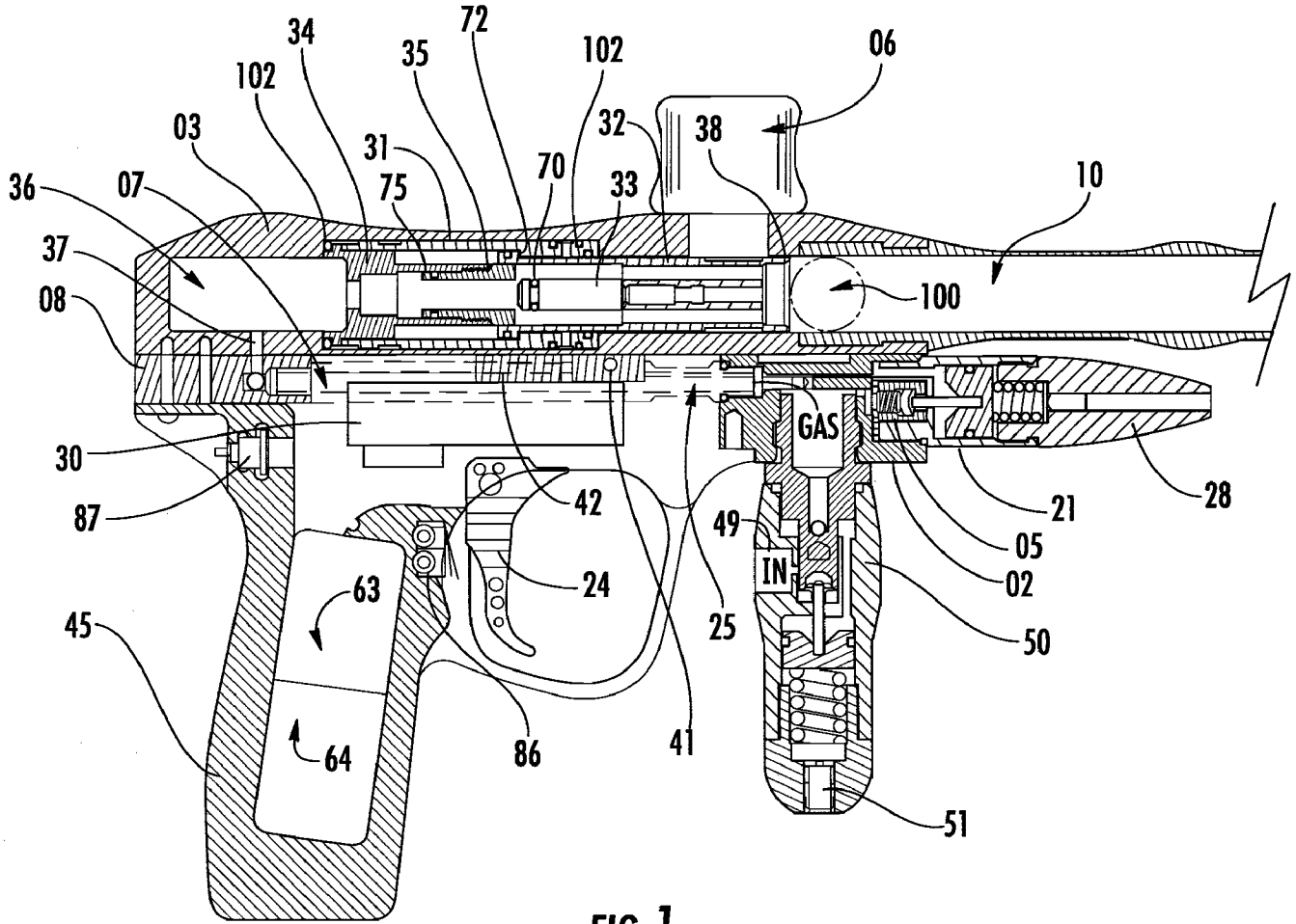
FIG. 1 is a side view of a compressed gas gun utilizing a variable pneumatic sear in the firing position.
Figure 2:
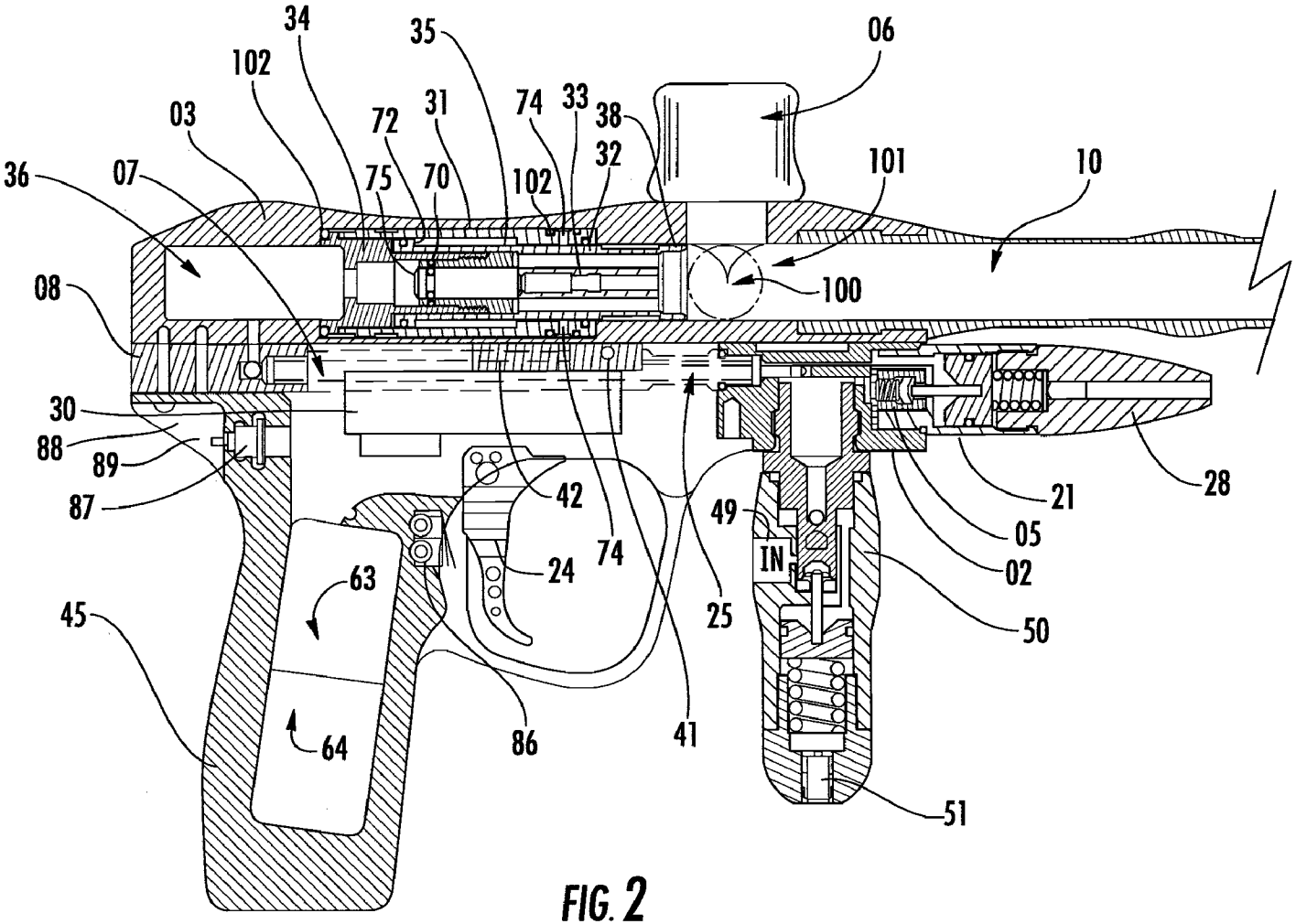
FIG. 2 is a side view of a compressed gas gun utilizing a variable pneumatic sear in the loading position.

FIGS. 1-5 illustrate of a compressed gas gun incorporating a pneumatic sear. Referring to FIGS. 1 and 2, a paintball gun generally comprises a main body 3, a grip portion 45, a trigger 24, a feed tube 6, and a barrel 10. These components are generally constructed out of metal or a suitable substance that provides the desired rigidity of these components. Main body 3 generally is connected to a supply of projectiles by feed tube 6 as understood by those skilled in the art. Main body 3 is also connected to grip portion 45, which houses the trigger 24, battery 64 and circuit board 63. The trigger 24 is operated by manual depression, which actuates micro-switch 86 directly behind trigger 24 to send an electrical signal to circuit board 63 to initiate the launching sequence. Barrel 10 is also connected to body 3, preferably directly in front of feed tube 6, to allow a projectile to be fired from the gun.

Hereinafter, the term forward shall indicate being towards the direction of the barrel 10 and rearward shall indicate the direction away from the barrel 10 and towards the rear of main body 3. Preferably forward of the grip portion 45, and also attached to main body 3, the regulator mount 2 houses both the low-pressure regulator 21 and the high-pressure regulator 50. Compressed gas is fed from preferably a compressed gas tank into the input port 49 on high-pressure regulator 50 to be directed to tube 7 to launch a projectile and to be directed to low pressure regulator 21 to cock the bolt tip 38 for loading. Both regulators 21, 50 are constructed from principles generally known to those skilled in the art, and have adjustable means for regulating compressed gas pressure.

Figure 3:
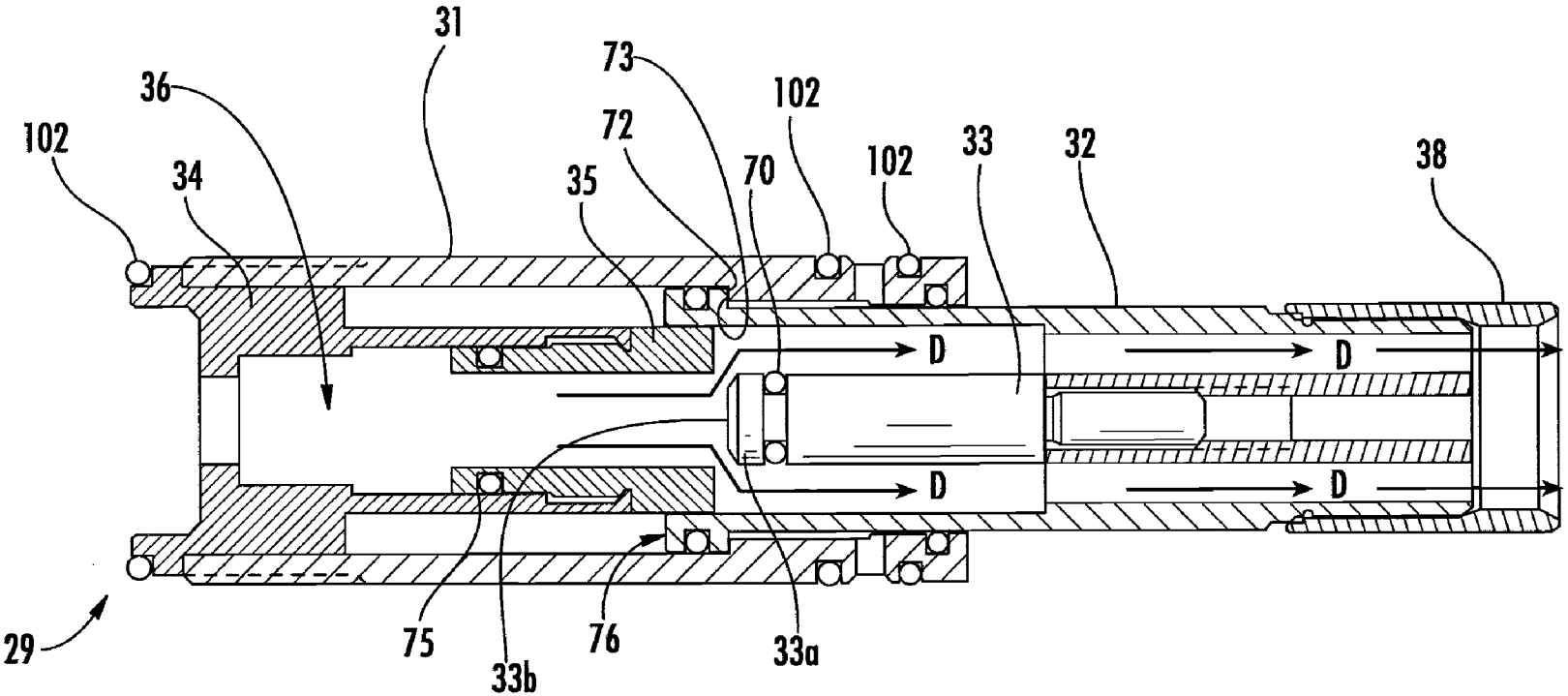
FIG. 3 is an expanded view of the variable pneumatic sear in the loading position.
Figure 4:
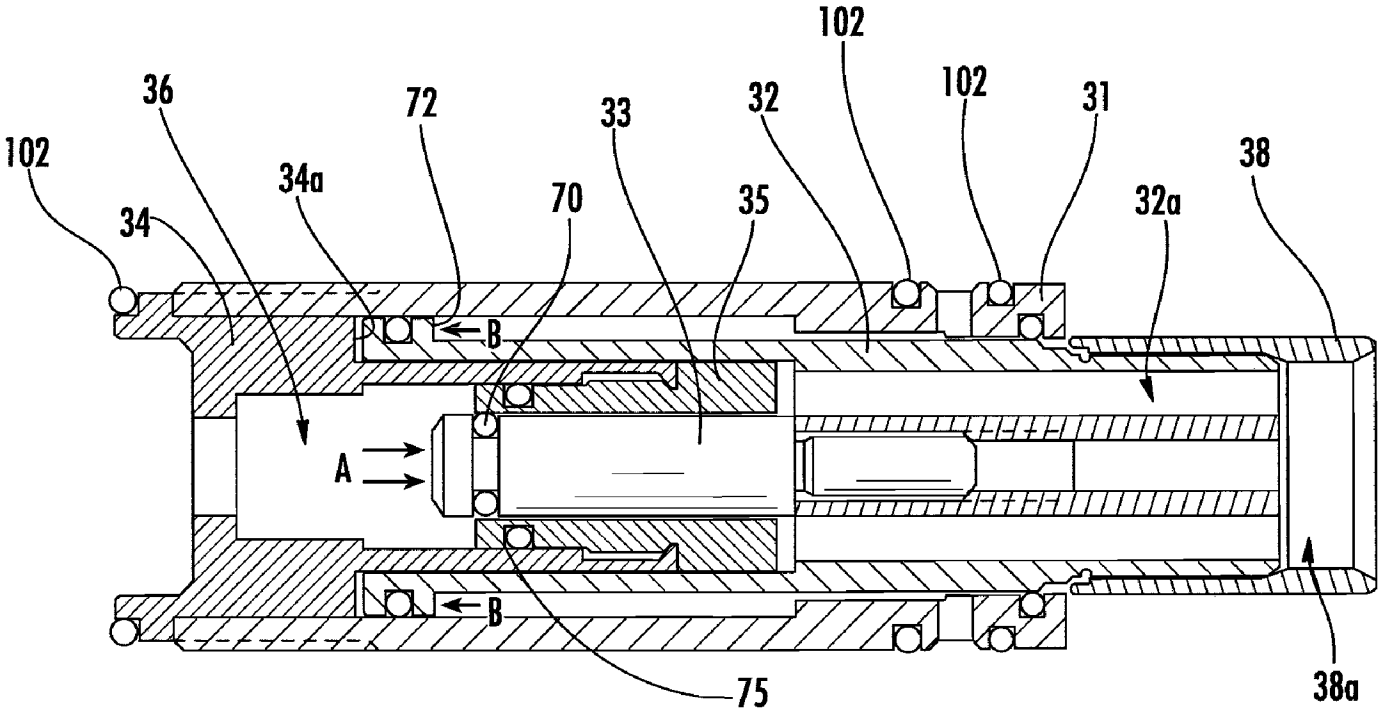
FIG. 4 is an expanded view of the variable pneumatic sear in the launching position.
Figure 5:
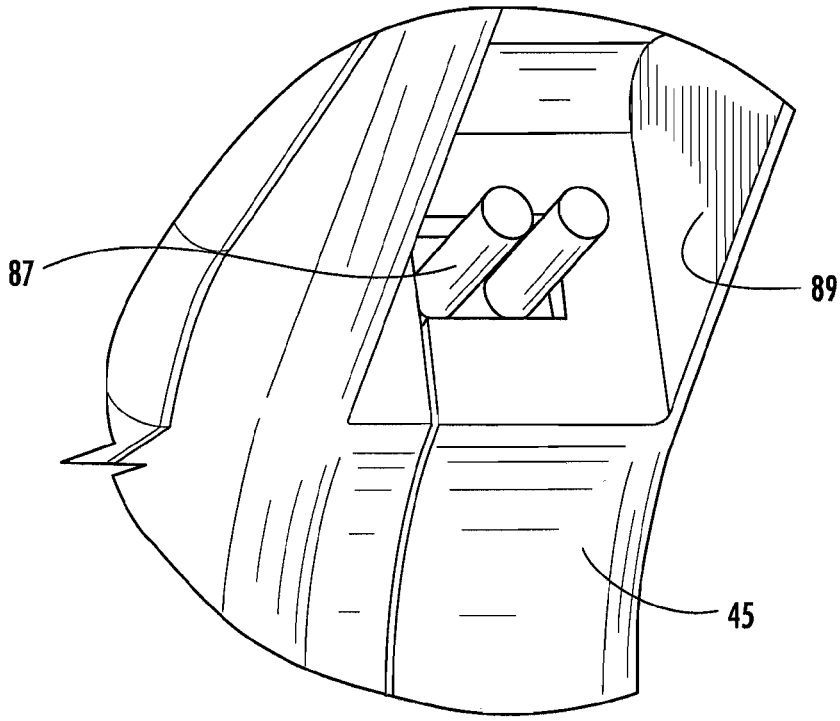
FIG. 5 is an expanded isometric view of the switches located within the recess.

Referring more particularly to FIGS. 3 and 4, housed within main body 3 is the firing mechanism of the gun. Firing mechanism preferably consists of a bolt tip 38, which is preferably constructed out of delrin or metal and is connected to piston 32, housed in cylinder body 31. Piston 32 is also constructed out of delrin or metal, and is connected to valve pin 33, housed on the interior of piston 32. In the loading position, valve pin 33 is forced rearward and seal 70 (located on a rearward portion 33*a* of the valve pin 33) is pushed against the lip 75 of valve housing tip 35, holding high-pressure compressed gas A on the rearward face 33*b* of valve pin 33 and preventing the flow through bolt tip 38. All seals, including o-ring 70 are constructed out of urethane, BUNA, or TEFLON, or any other substance that effectively prevents gas leakage beyond the surface of the seal. Valve housing tip 35 is integrally connected to valve housing 34, which prevents leakage of high-pressure compressed gas around the valve housing 34. Seals 102 also prevent leakage of high-pressure gas and are placed at each connecting section of the various components. Cylinder 31 surrounds valve housing 34 and provides sealed housing for piston 32, which contains a first surface 72 for low pressure gas B to flow into to drive piston 32 rearward and seal valve pin 33 against tip 35. Valve housing 34 preferably contains an interior chamber 36 for storing compressed gas to be used to fire a projectile from the gun.

The variable pneumatic sear 29 of the compressed gas gun of the present invention preferably consists of a control valve 30, a piston 32, residing in preferably sealed cylinder housing 31. Control valve 30 directs low pressure compressed gas from low pressure regulator 21 through manifold 41 to the cylinder housing 31, allowing gas to contact first surface of piston 32, driving the piston 32 rearward to seat the valve pin 33 when de-actuated, which is considered the loading position. The low pressure compressed gas is able to drive the piston 32 rearward against high-pressure gas pressure on valve pin 33 because the surface area of first surface 72 of piston 32 is larger than that of the surface of valve pin 33. Control valve 30 preferably consists of a normally open three-way valve. When actuated, a normally open valve will close its primary port and exhaust gas from the primary port, thereby releasing pressure from the first surface of piston 32, through a port 42 drilled into manifold 41. This allows high pressure compressed gas, pushing against the smaller surface area of valve in 33, to drive pin 33 forward and break the seal by o-ring 70 to release the stored gas from valve housing 34. Compressed gas then flows around valve pin 33, through ports 32*a* in piston 32, and out through bolt tip 38 to launch a projectile from the barrel 10.

Control valve 30 is preferably controlled by an electrical signal sent from circuit board 63. The electronic control circuit consists of on/off switch 87, power source 64, circuit board 63, and micro-switch 86. When the gun is turned on by on/off switch 87, the electronic control circuit is enabled. For convenience, the on/off switch 87 (and an optional additional switches, such as that for adjacent anti-chop eye that prevents the bolt's advance when a paintball 100 is not seated within the breech) is located on the rear of the marker, within a recess 88 shielded on its sides by protective walls 89. This location protects the switch 87 from inadvertent activation during play. The switch 87 is preferably illuminated by LEDs.

When actuating switch 86 by manually depressing trigger 24, an electrical signal is sent by circuit board 63 to the control valve 30 to actuate and close the primary port, thereby releasing valve pin 33 and launching a projectile. Once the momentary pulse to the control valve 30 is stopped by circuit board 63, the electronic circuit is reset to wait for another signal from switch 86 and the gun will load its next projectile. In this manner, the electrical control circuit controls a firing operation of the compressed gas gun.

A description of the gun's operation is now illustrated. The function of the pneumatic sear is best illustrated with reference to FIGS. 3 and 4, which depict the movements of piston 32 more clearly. Compressed gas enters the high-pressure regulator 50 through the input port 49. The high-pressure regulator is generally known in the art and regulates the compressed gas to about 200-300 p.s.i. These parameters may be changed and adjusted using adjustment screw 51. which is externally accessible to a user for adjustment of the gas pressure in the high-pressure regulator. This high-pressure gas is used to actuate the firing valve and launch a projectile from the barrel 10 of the compressed gas gun. Upon passing through high-pressure regulator 50, compressed gas is fed both through gas transport tube 7 to the valve chamber 36 via manifold 8, and through port 5 to the low pressure regulator 21. Low-pressure regulator 21 is also generally known in the art. Compressed gas is regulated down to approximately between 50-125 p.s.i. by the low-pressure regulator, and is also adjusted by an externally accessible adjustment screw/cap 28, which is preferably externally manually adjustable for easy and quick adjustment. Compressed gas then passes through port 25 into manifold 41, where electro-pneumatic valve 30 directs it into cylinder housing 31 through low pressure passages 74 and low pressure gas pushes against first surface 72 on piston 32, driving it rearwards and seating seal 70 against valve housing tip 35. Note that piston's 32 movement in the rearward direction is limited by contact between the second surface 76 and a stop 34*a* on the valve housing 34.

This allows bolt tip 38 to clear the breech area of the body 3, in which stage a projectile 100 moves from the feed tube 6 and rests directly in front of bolt tip 38. The projectile is now chambered and prepared for firing from the breech. The high-pressure compressed gas, which has passed into the valve chamber 36 via high pressure passage 37, is now pushing against valve pin 33 on the rear of piston 32. The seal created by o-ring 70 on valve pin 33 is not broken because the force of the low-pressure gas on the first side of cylinder 31 is sufficient to hold the valve pin 33 rearward.

When trigger 24 is depressed, electro-pneumatic valve 30 is actuated preferably using a solenoid housed within the manifold 41, shutting off the flow of low-pressure gas to housing 31 and venting the housing 31 via manifold 41. This allows the higher pressure gas, which is already pushing against valve tip 33 from the rear, to drive valve tip 33 forward to the firing position and break the seal 72 against the housing 35. Bolt tip 38, which is connected to piston 32, pushes a projectile forward in the breech and seals the feed tube 6 from compressed gas during the first stage of launch because the valve pin 33 is still passing through valve housing tip 35 during this stage. This prevents gas leakage up the tube 6 and positions the projectile for accurate launch. Once the valve pin 33 clears the housing tip 35, a flow passage D is opened, and the higher pressure gas flows through ports 32*a*, 38*a* drilled through the interior of piston 32 and bolt tip 38 and propels the paintball from barrel 10. Note that the piston's 32 movement in the forward direction is limited by contact between the first surface 72 and a shoulder 73 within the cylinder 31.

The signal sent to electro-pneumatic valve 30 is a momentary pulse, so when the pulse ceases, the valve 30 is de-actuated. This allows low-pressure gas to enter cylinder housing 31 and drive valve piston 32 rearwards against the force exerted by high-pressure gas to the seated position and allow loading of the next projectile.

Since piston 32 has a larger surface area on its outside diameter than the surface area on the valve pin 33, low-pressure gas is able to hold high-pressure gas within the valve chamber 36 during the loading cycle of the gun. This is more advantageous than a design where a separate piston is used to actuate a separate valve, because the step of actuating and de-actuating the piston is removed from the launch cycle.

In addition, the pressures of the low pressure gas and high pressure gas may be varied according to user preference, thereby allowing for many variable pneumatic configurations of the gun and reducing problems with erratic cycling caused by using the same gas to control both the recock and launch functions of the gun. Because the mechanical sear is eliminated, the gun is also extremely lightweight and recoil is significantly reduced. The gun is also significantly faster than existing designs because the independent piston operation is eliminated.

In an alternate embodiment, the compressed gas gun can operate at one operating pressure instead of having a high-pressure velocity circuit and a low-pressure recock circuit. This is easily accomplished by adjusting the ratio of the surface sizes of the first surface 72 and the valve pin 33. In this manner, the size of the gun is reduced even more because low-pressure regulator 21 is no longer needed.

While the present invention is described as a variable pneumatic sear for a paintball gun, it will be readily apparent that the teachings of the present invention can also be applied to other fields of invention, including pneumatically operated projectile launching devices of other types. In addition, the gun may be modified to incorporate a mechanical or pneumatic control circuit instead of an electronic control circuit, for instance a pulse valve or manually operated valve, or any other means of actuating the pneumatic sear.

It will be thus seen that the objects set forth above, and those made apparent from the preceding description, are attained. It will also be apparent to those skilled in the art that changes may be made to the construction of the invention without departing from the spirit of it. It is intended, therefore, that the description and drawings be interpreted as illustrative and that the following claims are to be interpreted in keeping with the spirit of the invention, rather than the specific details, set forth.

It is also to be understood that the following claims are intended to cover all the generic and specific features of the invention herein described and all statements of the scope of the invention that, as a matter of language, might be said to fall therebetween.

What is claimed is:

1. A compressed gas gun comprising:

a cylinder;

a firing mechanism comprising an integrally formed piston, bolt and a valve pin slidable in the cylinder, at least a part of the valve pin received coaxially within an interior portion of the piston;

compressed gas at a first pressure that biases the firing mechanism in a first direction;

compressed gas at a second pressure different than the first pressure that biases the firing mechanism in a second direction, and overcomes a force exerted by the first pressure biasing the firing mechanism in the first direction so that the firing mechanism moves in the second direction; and a valve that, in response to a signal, decreases the compressed gas at the second pressure to allow the compressed gas at the first pressure to bias the firing mechanism in the first direction, which in turn releases the compressed gas at a first pressure to fire a projectile from the gun.

2. The gun of claim 1, further comprising:

a source of compressed gas that supplies compressed gas at the first pressure; and a regulator that decreases the first pressure to the second pressure.

3. The gun of claim 2, wherein the second pressure is adjustable.

4. The gun of claim 2, wherein the regulator is adjustable by turning an externally accessible adjustment cap.

5. The gun of claim 1, wherein the valve decreases the second pressure by venting the compressed gas at a second pressure.

6. The gun of claim 1, further comprising:

a trigger that when depressed, sends the signal to the valve.

7. The gun of claim 5, wherein the signal is pulsed in such a manner that once the compressed gas at a high pressure is released, the valve ceases decreasing the second pressure.

8. The gun of claim 1, wherein the first direction is a forward direction corresponding to a direction from which the paintball exits the marker, and a rearward direction is a direction substantially opposite that of the forward direction.

9. The gun of claim 8, wherein the cylinder further comprises a valve housing tip fixed within a valve housing within the cylinder, that is sized to receive a rearward portion of the valve pin when the compressed gas at the second pressure biases the firing mechanism in the second direction, the rearward portion having a face upon which the compressed gas at the first pressure acts to bias the firing mechanism in the forward direction.

10. The gun of claim 9, wherein the compressed gas at the second pressure acts on a first surface of the firing mechanism to bias the firing mechanism in the rearward direction.

11. The gun of claim 10, wherein when the compressed gas at the second pressure acts to bias the firing mechanism in the forward direction, the movement of the firing mechanism in the forward direction limited by contact between a first surface and a decreased diameter within the cylinder.

12. The gun of claim 10, wherein when the compressed gas at the second pressure acts to bias the firing mechanism in the rearward direction, the movement of the firing mechanism in the rearward direction is limited by contact between a second surface and a stop on the valve housing.

13. The gun of claim 10, wherein when the compressed gas at the second pressure acts to bias the firing mechanism in the forward direction, the movement of the firing mechanism in the forward direction is limited by contact between the first surface and a shoulder within the cylinder;

wherein when the compressed gas at the second pressure acts to bias the firing mechanism in the rearward direction, the movement of the firing mechanism in the rearward direction is limited by contact between a second surface and a stop on the valve housing;

and wherein a surface area of the first surface is greater than a surface area of the face.

14. The gun of claim 1, further comprising a control switch that controls at least one function of the gun, the switch located within a recess within the gun.

15. The gun of claim 14, wherein the recess is located in an indentation in a rear portion of the gun body, behind a trigger.

16. The gun of claim 15, wherein the recess is located below the cylinder.

17. The gun of claim 14, wherein the recess is defined by at least two sidewalls located on either side of the switch.

18. The gun of claim 14, further comprising a second switch located within the recess, for controlling at least one function of the gun.

19. The gun of claim 14, wherein the switch is illuminated.

20. A compressed gas gun comprising:

a cylinder comprising a piston having an effective surface area and including an integral valve pin having an effective surface area smaller than the effective surface area of the piston, the piston slidable in the cylinder from a rearward position to chamber a projectile to a forward position to fire a projectile;

compressed gas at a first pressure configured to communicate with the surface area of the piston to bias the position in a rearward direction to selectively close a flow path;

compressed gas at a second higher pressure configured to communicate with the surface area of the valve pin to bias the valve pin in a forward direction, the compressed gas at a first pressure and the compressed gas at a second higher pressure configured to hold the piston in a rearward ready to fire position when applied together; and a valve configured to selectively decrease the first pressure to allow the compressed gas at the second higher pressure to bias the piston in the forward direction, to open the flow path to fire a projectile from the compressed gas gun; and, a trigger for operating the valve.

21. The gun of claim 20, further comprising:

a source of compressed gas that supplies compressed gas at the second higher pressure; and a regulator that decreases the second higher pressure to a lower pressure.

22. The gun of claim 21, wherein the second higher pressure is adjustable.

23. The gun of claim 20, wherein actuation of the valve decreases the compressed gas at the first pressure by venting the compressed gas.

24. The gun of claim 20, wherein the trigger is configures to send a signal to the valve.

25. The gun of claim 20, wherein the compressed gas at a second higher pressure is supplied continually to the effective surface area of the valve pin during gun operation.

26. The gun of claim 20, wherein the compressed gas at a first pressure is supplied selectively to the surface area of the piston.

27. The gun of claim 20, wherein the cylinder further comprises a valve housing tip fixed within a valve housing within the cylinder, the valve housing tip sized to receive a rearward portion of the valve pin when the compressed gas at a first pressure biases the piston in the rearward direction, the rearward portion having a face upon which the compressed gas at a second pressure acts to bias the piston in the forward direction.

28. The gun of claim 20, further comprising a switch that controls gun at least one function of the gun, the switch located within a recess within the gun located in a rear portion of the gun behind a trigger, the recess defined by at least two sidewalls located on either side of the switch.

29. The gun of claim 28, further comprising a second switch located within the recess, for controlling at least one function of the gun.

30. A compressed gas gun comprising:

a cylinder for housing pneumatic components;

a bolt having a first effective surface area and a second effective surface area, the second surface area smaller than the first effective surface area, the bolt slidable within the cylinder in a rearward direction under a first pressure exerted by compressed gas in communication with the first surface area of the bolt, the bolt slidable within the cylinder in a forward direction under a second pressure exerted by compressed gas in communication with the second surface area of the bolt;

the compressed gas in communication with the first surface area selectively regulated via a trigger actuated valve; and, the compressed gas in communication with the second surface area supplied continually from a source of compressed gas;

wherein the bolt is configured to open a flow path to fire a paintball from the gun by the compressed gas when the bolt moves to a forward position.

31. The gun of claim 30, further comprising a switch that controls at least one function of the gun, the switch located within a recess within the gun, wherein the recess is located in a rear portion of the gun, rearward the trigger.

32. The gun of claim 31, further comprising a second switch located within the recess, for controlling at least one function of the gun.

33. A compressed gas gun comprising:

a cylinder for housing pneumatic components;

a bolt having an integrally formed bolt pin received coaxially within a passage in the bolt, the bolt slidable within the cylinder in a rearward direction under a first pressure exerted by compressed gas in communication with a forward portion of the cylinder, the bolt slidable within the cylinder in a forward direction under a second pressure exerted by compressed gas in communication with a rearward portion of the cylinder;

a cylindrical valve housing arranged in the cylinder between the rearward portion of the cylinder and the forward portion of the cylinder, the valve housing adapted to coaxially receive a rearward portion of the bolt pin when the bolt is biased in a rearward direction;

wherein the pin is configured to open a flow path through the valve housing when the pin moves to a position forward the valve housing.

* * * * *